United States Patent [19]

Ting

[11] 4,413,458

[45] Nov. 8, 1983

[54] BUILDING WALL LINER ASSEMBLY

[76] Inventor: Raymond M. L. Ting, 318 Holiday Dr., Pittsburgh, Pa. 15237

[21] Appl. No.: 260,342

[22] Filed: Aug. 5, 1981

[51] Int. Cl.[3] ..... E04C 3/00

[52] U.S. Cl. ..... 52/481; 52/235; 52/732; 52/763

[58] Field of Search ..... 52/481, 404, 732, 763, 52/479, 738, 235, 395, 483, 508, 547

[56] References Cited

U.S. PATENT DOCUMENTS

| | | | |
|---|---|---|---|
| 3,332,197 | 7/1967 | Hinkle | 52/732 X |
| 3,474,583 | 10/1969 | Manias | 52/481 X |
| 3,904,380 | 9/1975 | Smith | 52/732 X |
| 3,998,016 | 12/1976 | Ting | 52/481 X |
| 4,044,521 | 8/1977 | Fischer et al. | 52/479 X |

FOREIGN PATENT DOCUMENTS

| | | | |
|---|---|---|---|
| 1483622 | 8/1977 | United Kingdom | 52/732 |

*Primary Examiner*—J. Karl Belli

[57] ABSTRACT

An improved double skin metal wall liner for a building formed from spaced-apart structural liner panels and interposed non-structural liner panels. The non-structural liner panels are formed from sheet metal having less thickness than the structural liner panels. Both panels are secured to a building framework and to each other. The outboard ends of the structural liner panels comprise mounting surfaces for fastening an outer facing wall for the building.

14 Claims, 16 Drawing Figures

BUILDING WALL LINER ASSEMBLY

BACKGROUND OF THE INVENTION

1. Field of the Invention

This invention relates to an improved metal building wall liner assembly and to double skin wall constructions employing the liner assembly.

2. Description of the Prior Art

Double skin wall constructions employ profiled sheet metal liner panels which are secured to the structural framework of a building. The liner panels typically are from two feet to five feet wide and are essentially flat except for stiffening beads, if desired. The edges of the liner panels are bent outwardly from the building framework to provide for side-by-side engagement with other liner panels.

The joined edges of the liner panels function as mounting elements for securing an outer facing wall to the building structure. In one form, the outer facing wall comprises parallel facing panels which are secured directly to the assembled liner panels, perpendicularly to the liner panel joints. In another embodiment, subgirt elements are secured perpendicularly to the liner panel joints and facing panels are secured to the subgirt elements. In both embodiments, thermal insulation material is introduced into the space between the liner panels and the facing panels.

A serious shortcoming of the existing double-skin wall construction is that the liner panels are fabricated from sheet steel of uniform thickness. The metal thickness is determined by the requirement for forming connected joint elements to serve as mounting sites in the resulting wall. With increasing requirements for thermal insulation in such double-skin wall constructions, the wall thickness and hence, the side joints of the liner panels must be increased, whereby the web-strength of the joint elements becomes the controlling design limitation and requires even greater steel thickness for the liner panels.

A corollary shortcoming of the existing liner panel construction is that the preponderance of the steel in the liner panels is "ineffective" for design purposes, that is, under the existing design codes, the preponderance of the steel in the liner panels does not contribute to the load carrying capability of the resulting wall assembly.

It is desirable that building components intended for use in wall panel construction are nestable to reduce shipping volume. Many of the liner panels in the prior art are not nestable because of their geometry and therefore require excessive packaging, handling and transportation expenses.

For versatility, it is desirable that liner panels accommodate a variety of different facing panels to permit achieving different architectural appearances in the exterior wall of the resulting building. Thus, it is desirable that liner panels be available in different widths, not only to accommodate different facing panels which might be desired, but also to optimize the structural design of the resulting building.

Building wall panels also should have reliable and simple connecting means to develop an airtight skin for the interior wall surface of the building.

STATEMENT OF THE INVENTION

According to the present invention, an improved building wall liner assembly employs spaced apart sheet metal structural liner panels and interposed sheet metal non-structural liner panels. The spaced apart structural liner panels are formed from sheet metal having a thickness which is determined by the structural requirements of the building wall. The interposed non-structural liner panels have a metal thickness which is significantly less than the metal thickness of the structural liner panels. The non-structural liner panels have lateral connecting means to engage the spaced apart structural liner panels. The structural liner panels have a first flange which is secured to the building framework and is in a common surface with the central surfaces of the interposed sheet metal non-structural liner panels. The structural liner panels also have a web which extends outwardly from the building framework and terminates in a second flange. The second flanges of the structural liner panels are in a common surface and serve as a mounting site for direct connection of facing panels or for connection of subgirt elements which in turn serve as a mounting site for facing panels.

The resulting wall liner assembly provides an airtight construction as a result of simple positive connections which can be achieved between the structural liner panels and the marginal connecting elements of the interposed non-structural liner panels. The structural liner panels can be applied to the building framework vertically or horizontally. The resulting wall normally will be a flat surface, but can be readily adapted to arcuate or cylindrical surfaces.

Because of the nestability of the components, the liner wall assembly has an efficient shipping volume.

Because of the optimum exploitation of the steel in the liner wall assembly, the liner wall assembly has significantly lower weight, yet greater structural strength than the prior art liner panel constructions. In the improved liner wall assembly, the non-structural liner panels function to provide air containment for the interior of the building, to confine thermal insulation for the building, and to provide a flat, pleasing appearance for the interior wall surface—all of which functions are unrelated to any structural requirements for the non-structural liner panels.

Because of the independence of the spaced apart structural liner panels compared to the interposed non-structural liner panels, it is possible to design the structural liner panels independently to achieve the requisite structural load carrying capacity and the desired depth to accommodate greater thicknesses of thermal insulation.

A further wholly unexpected benefit of the present wall liner construction is the realization that the load-carrying requirement of the facing panels in the resulting completed wall can be significantly reduced; hence significantly reduced thickness facing panels can be employed. The facing panels of existing double-skin wall designs are usually corrugated elements which have appreciable load carrying capability. Architecturally flat facing panels can be disregarded for strength contributions in the resulting wall construction.

DESCRIPTION OF THE PREFERRED EMBODIMENTS

Figure 1:
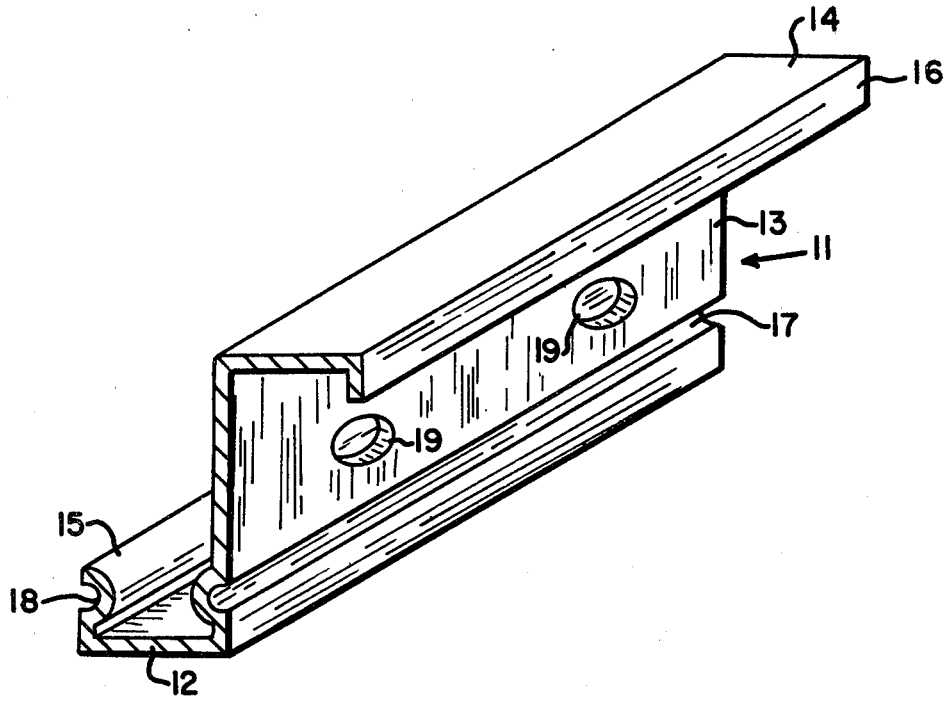
FIG. 1 is a perspective illustration of a sheet metal structural liner panel.

A structural liner panel 11, illustrated in FIG. 1, includes a first flange 12, a web 13 and a second flange 14. The first flange 12 and the second flange 14 are parallel to each other and extend in opposite directions from the web 13. A terminal lip 15 extends away from the outer edge of the first flange 12. A terminal lip 16 extends inwardly from the outer edge of the second flange 14. In the embodiment illustrated in FIG. 1, a groove 17 is provided in the web 13 spaced away from the intersection of the web 13 with the first flange 12. A similar groove 18 is provided in the terminal lip 15, spaced apart from the intersection of the terminal lip 15 with the first flange 12. If desired, weep holes 19 may be provided in the web 13. The first flange 12 is essentially flat and is adapted to be secured to a building framework by means of screws, welding or other positive connection means. The second flange 14 is adapted to receive facing panels or to receive subgirt members depending upon the nature of the double-skin wall. The structural liner panels 11 are fabricated from steel such as cold rolled steel having a thickness from about 20 to 10 gauge, i.e. 0.91 to 3.42 millimeters. Typically the first flange 12 has a width of 1 to 4 inches; the second flange 14 has a width from about 1 to 3 inches; the web 13 has a depth of about 1.5 to 6 inches. The terminal lip 16 of the second flange 14 may be omitted, particularly when heavy gauge metal is used for the structural liner panels 11.

Figure 2:
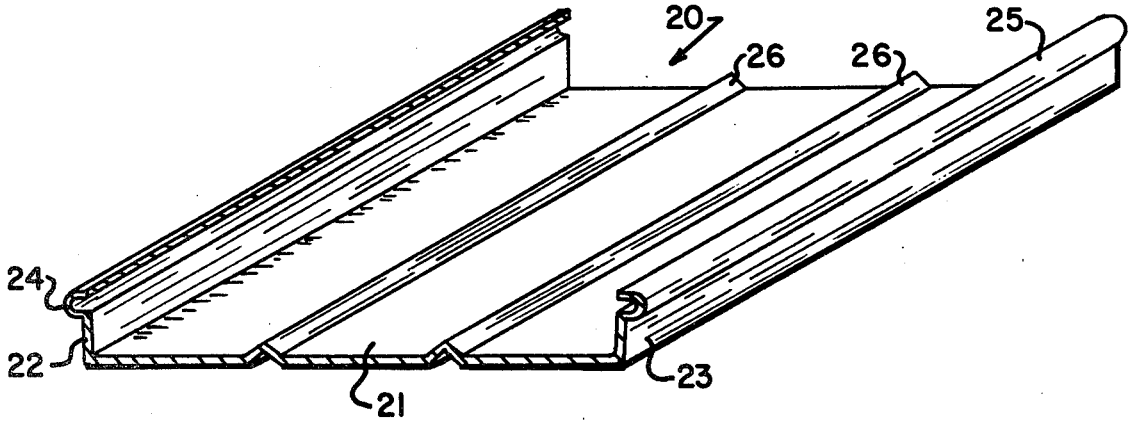
FIG. 2 is a perspective illustration of a sheet metal non-structural liner panel.

Non-structural liner members 20 are illustrated in FIG. 2 and include an essentially flat central portion 21 and outwardly extending lips 22, 23 which extend in the same direction away from the central flat portion 21. Each of the lips 22, 23 has a lengthwise bead 24, 25 respectively which is spaced apart from the intersection of the lips 22, 23 with the flat central portion 21. The beads 24, 25 are engagable with a groove 17, 18 of the structural liner panels 11 of FIG. 1. If desired, reinforcing ribs 26 or other surface deformations may be provided in the essentially flat central portion 21 for stiffening purposes or for appearance. Typically the non-structural liner panel 20 will be fabricated from steel sheets of 26 to 20 gauge thickness (i.e., 0.45 to 0.91 millimeters), signficantly thinner than the metal which forms the structural liner panels 11. The lips 22, 23 preferably extend from $\frac{1}{2}$ to $1\frac{1}{2}$ inches away from the flat central portion 21. A typical non-structural liner panel 20 has a width according to the needs of the resulting building, from about 12 inches to about 48 inches.

Figure 3:
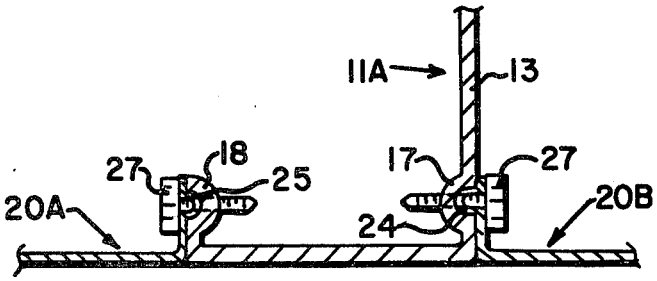
FIG. 3 is a fragmentary illustration in cross-section showing one embodiment for assembling a structural liner panel with adjoining non-structural liner panels.

The liner wall assembly is completed as shown in FIG. 3 by engaging beads 24, 25 of non-structural liner panels **20*a*, 20*b* with the corresponding grooves 18, 17 respectively of a structural liner panel 11*a*. Appropriate fasteners such as self-drilling, self-tapping fasteners 27 are inserted to join the bead 24 and groove 17 and join the bead 25 and groove 18. Preferably a supply of sealant material is provided between the beads 24, 25 and the respective engaged grooves 17, 18**.

Figure 5:
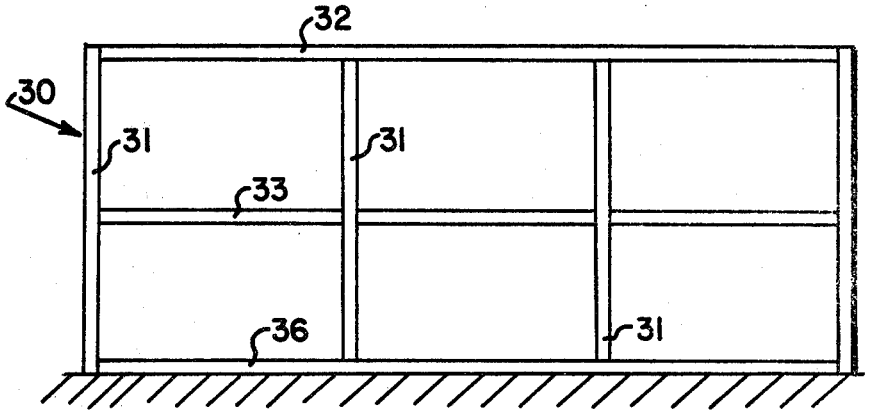
FIG. 5 is a side elevation of a representative building framework.

The liner wall construction of this invention can be applied to a building framework 30 as shown in FIG. 5 which includes vertical columns 31, horizontal beams 32 and horizontal girts 33, and, occasionally a horizontal base member 36.

Figure 6:
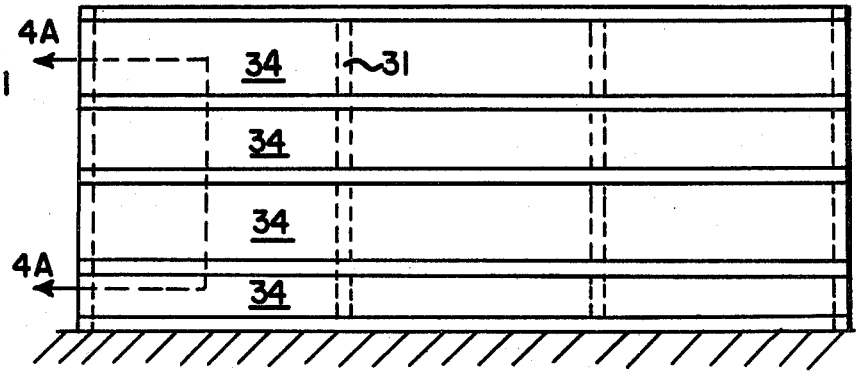
FIG. 6 is a side elevation view of the building framework of FIG. 5 having a horizontally secured liner panel wall.
Figure 7:
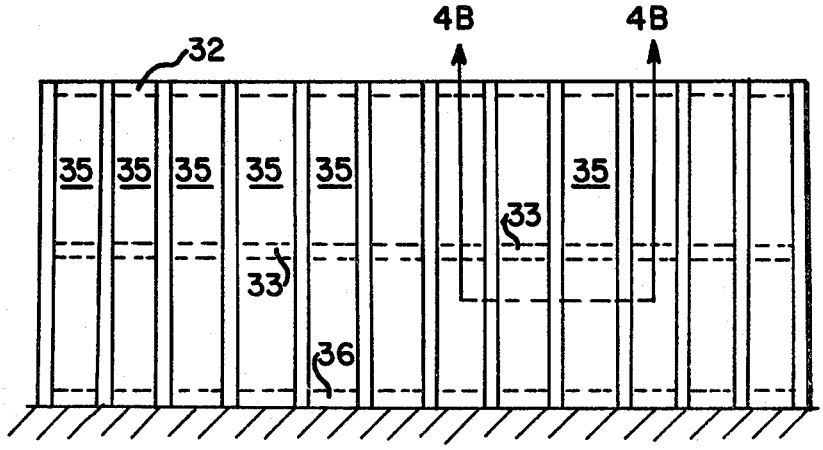
FIG. 7 is a side elevation view of the building framework of FIG. 5 showing a vertically secured liner wall.

The liner panels may be applied to the framework 30 as shown in FIG. 6 horizontally by connecting the panels 34 to the vertical columns 31. Alternatively, as shown in FIG. 7, the liner panels may be applied vertically by connecting the panels 35 to the horizontal beams 32, to the horizontal girts 33 and to the horizontal base member 36.

Figure 4:
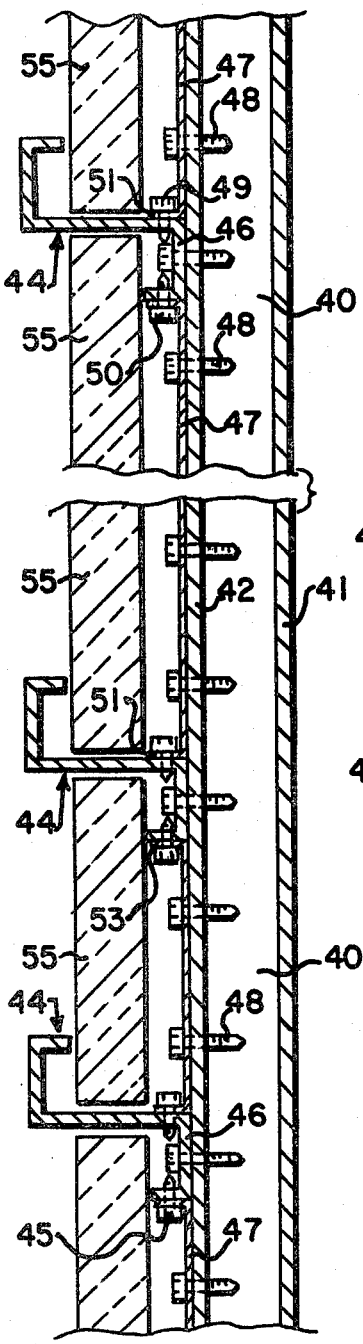
FIG. 4 is a fragmentary cross-sectional view showing the liner wall of the present invention secured to a building framework.

The assembly of the liner wall is more fully illustrated in FIG. 4 wherein a structural steel member 40 (illustrated as an I-beam) includes flanges 41, 42 and a web 43. Structural liner panels 44 are secured to the steel member 40 at spaced apart locations by means of fasteners 45 which are driven through the first flange 46 and through the flange 42 of the steel member 40. Alternatively the structural liner panels 44 can be secured to the steel member 40 by welding or other fastening techniques. The outer surfaces of the flanges 42 of the steel member 40 are initially arranged in a coplanar relationship by the steel fabricator. Interposed non-structural liner panels 47 are secured to the building framework by means of fasteners 48 which secure them directly to the flange 42 of the steel member 40.

Non-structural liner panels 47 are further secured directly to the structural liner panels 44 by means of fasteners 49, 50 which extend through the lips 50, web 51 and through the lip 52 and terminal lip 53, respectively. The lips 51, 53 are provided with lengthwise beads; the web 52 and terminal lip 54 will be provided with corresponding lengthwise grooves. Normally a bead of sealant material is positioned in the grooves of the structural liner panel 44 before the fasteners 49, 50 are installed.

It will be observed from FIG. 4 that a protective pocket is formed for receiving rectangular batts 55 of thermal insulating material such as glass fiber insulating batts.

The length of the webs 52 of the structural liner panels 44 is selected to accommodate the thickness of the batts 55 of thermal insulating material. The liner wall assembly of FIG. 4 is the same regardless of whether the liner panels are assembled horizontally as shown in FIG. 6 or vertically as shown in FIG. 7. Thus FIG. 4 may be considered as a view taken along the line 4A—4A of FIG. 6 in which case the steel member 40 is a vertical column 31. Alternatively, the liner wall assembly of FIG. 4 may be considered as a vertical wall assembly as taken along the line 4B-4B of FIG. 7 in which case the structural steel member 40 corresponds to the horizontal girt 33.

Figure 8:
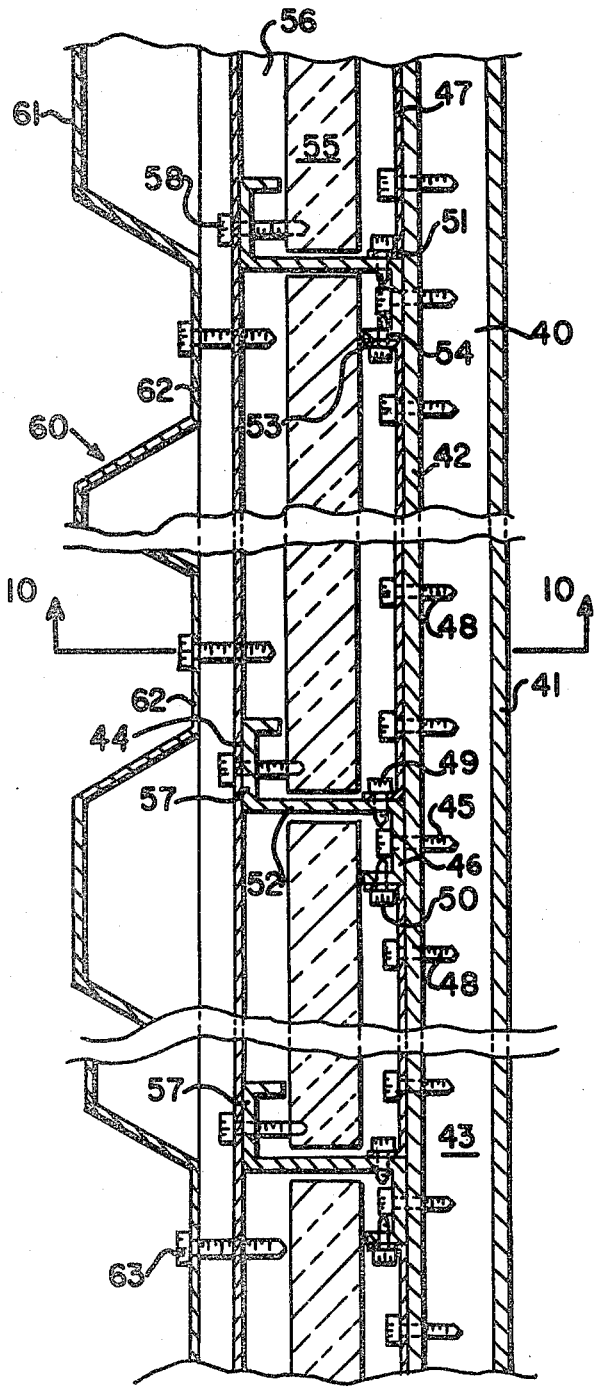
FIG. 8 is a fragmentary cross-section illustration of a wall construction employing a liner wall of FIG. 4, subgirt elements and a facing wall.
Figure 9:
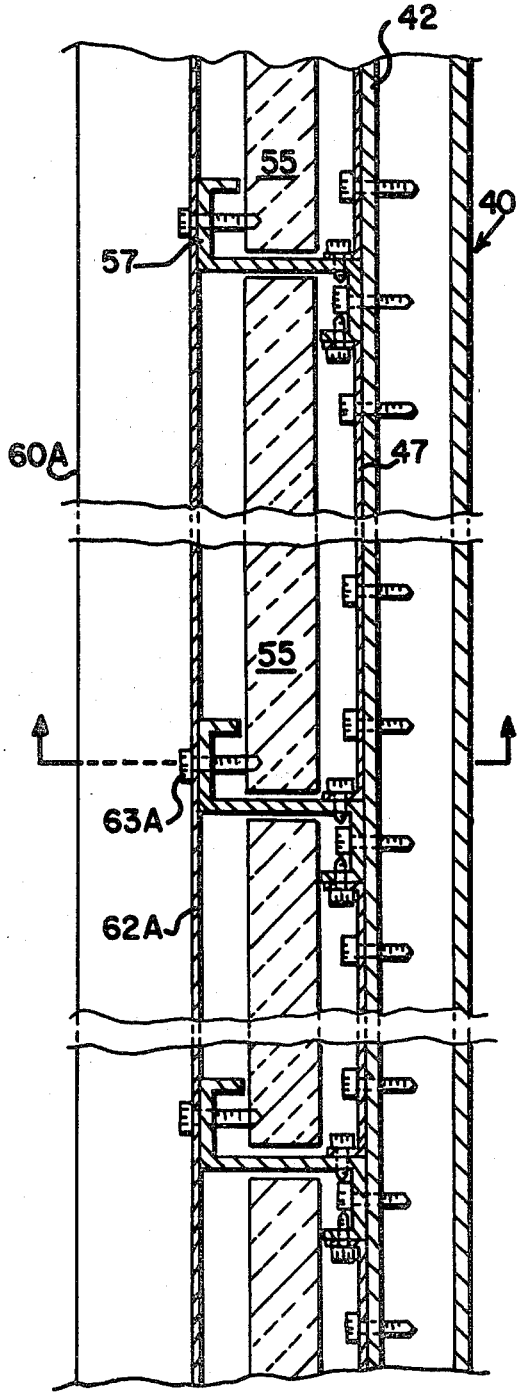
FIG. 9 is a fragmentary cross-section illustration of a wall construction employing the liner wall of FIG. 4 and directly fastened facing wall panels.
Figure 10:
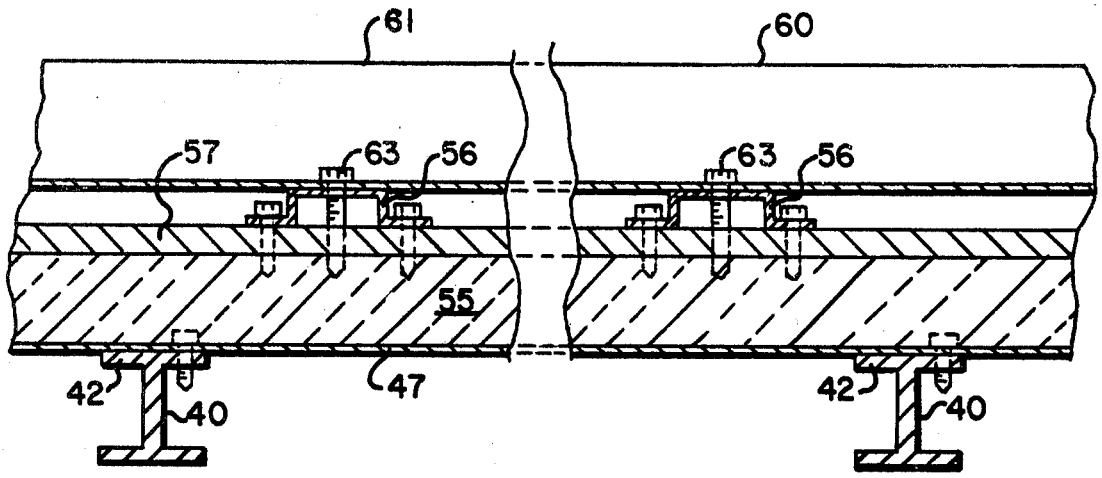
FIG. 10 is a fragmentary cross-section view of a wall construction taken along the line 10—10 of FIG. 8.
Figure 11:
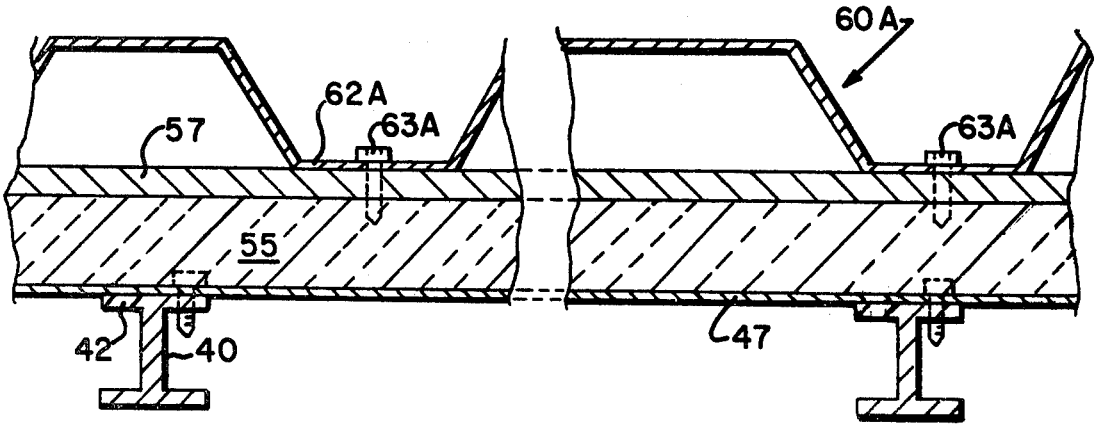
FIG. 11 is a fragmentary cross-section view of a wall construction taken along the line 11—11 of FIG. 9.

The wall construction is completed by securing facing panels to intermediate subgirts as shown in FIGS. 8, 10 or by securing facing panels directly to the structural liner panels 44 as shown in FIGS. 9, 11. The subgirt embodiment of FIGS. 8, 10 will be described. The structural liner panels 44 are secured to the flange 42 of a structural member 40 such as a column or girt of a building framework. Interposed non-structural liner panels 47 similarly are secured to the flange 42 of the structural member 40 and also have their lips 51, 52 secured to a web 52 and a terminal lip 54 respectively of the structural liner panel 44.

Subgirts 56 are secured to the second flange 57 by means of fasteners 58 which extend through one of the base flanges of each subgirt 56. The subgirts 56 assist in confining the batts 55 of thermal insulation.

An appropriate architecturally acceptable facing panel 60 is provided in the form of a corrugated sheet having crests 61 and intervening coplanar valleys 62. The facing panels 60 are secured to the subgirts 56 by means of fasteners 63 extending through the valleys 62.

In the resulting double-skin wall assembly, the applied loads are transferred from the facing panel 60 through the subgirts 56 and structural liner panels directly into the structural supporting member 40.

The alternative construction employs the liner wall of FIG. 4 in combination with facing panels which are secured directly to the second flanges of the structural liner panels as shown in FIGS. 9, 11. A facing panel 60A is secured directly to the assembled liner wall by means of fasteners 63A which extend through the valley surfaces 62A into the second flanges 57.

It will be observed that the wall structure of FIGS. 9, 11 provides a liner wall oriented perpendicularly to the facing wall and thus eliminates the need for interposed subgirts. Loads applied to the assembled wall structure are transmitted from the liner panels directly through the structural liner panels into the structural members 40 of the building frame.

EXAMPLE 1

The present wall construction is adapted to conventional wall framing systems. In this example the liner wall system is installed vertically spanning the distance between horizontal girts, beams and base elements. Horizontal subgirts are connected to the second flanges of the vertical structural liner panels. Facing panels span vertically and are connected to the subgirts with metal screws. In this embodiment, a substantial cost saving is achieved when compared with conventional liner wall installations. A significant savings in the weight of metal in the wall is achieved. A reduced shipping volume for the wall components likewise is achieved. For a specific installation, the following design parameters have been considered.

(a) Double span conditions at 12 feet spacing.
(b) Wind load is 30 lbs. per square foot.
(c) Facing panel is a V-beam panel supplied. by E. G. Smith Division of Cyclops Steel Corporation.
(d) The liner profile is 24 inch wide, 1.5 inch deep.
(e) Allowable deflection is 1/180 of the span length.
(f) Allowable metal stress in the facing elements and liner elements is 26,667 lbs. per square inch.
(g) The subgirts are provided at the supports and at the midspan positions.

The comparison of the conventional wall with a wall according to the present invention is set forth in the following table

TABLE 1

| | EXAMPLE 1 | | | | | |
|---|---|---|---|---|---|---|
| | CONVENTIONAL | | INVENTION Design #1 | | INVENTION Design #2 | |
| ITEM | Gauge | Wt* | Gauge | Wt* | Gauge | Wt* |
| Facing Panels | 20 | 2.02 | 22 | 1.71 | 20 | 2.02 |
| Liner Panels | 18 | 2.31 | — | — | — | — |
| Nonstructural Liner Panels | — | — | 26 | 0.758 | 26 | 0.758 |
| Structural Liner Panels | — | — | 12 | 0.775 | 18 | 0.354 |
| Total Wt* | | 4.33 | | 3.243 | | 3.132 |

*Pounds of metal per square foot of wall assembly

The non-structural liner panel of Example 1 had a width of 46 inches and lips of $\frac{3}{4}$ inch. The structural liner panel had a web of 1.5 inches, a first flange of 2 inches, a second flange of 2 inches, an outer terminal lip of $\frac{1}{2}$ inch and an inner terminal lip of $\frac{3}{4}$ inch. The design #1 of the present invention employed 26 gauge non-structural liner panels and 12 gauge structural liner panels. The design #2 of the present invention employed 26 gauge non-structural panels and 18 gauge structural liner panels. The material savings for design #1 was 25%; the material savings for design #2 was 28%. The liner wall of the present invention has the same number of pieces as the liner wall of the prior art and includes the same number of joints as the liner wall of the prior art. However, the liner wall of the present invention has one-half the number of thermal wicking elements, i.e., metallic paths of heat conduction extending from the outside wall surface to the inside wall surface. All three walls in Table 1 satisfy the design parameters.

Example 2

A wall construction is employed wherein the liner wall spans vertically between horizontal beams, girts and base members and is secured thereto. The facing panels are extended horizontally and are secured directly to the second flanges of the structural liner panels by means of metal screws, thereby achieving a two-way design. When compared with conventional double-skin wall construction, this system of Example 2 has substantial cost savings in the liner fastening methods and the facing panel fastening methods. The elimination of subgirts not only eliminates the expense of the subgirts and the expense of installing the subgirts but also permits the wall to employ a lighter gauge facing panel as a result of the two-way design. The shipping volume and total weight of all components is significantly reduced for the Example 2 as compared to the conventional double-skinned metal wall construction.

Example 3

A wall construction employs vertical building columns and intermediate vertical girts. The structural liner panel system is applied horizontally and is supported on the columns and vertical girts. Vertically presented facing panels are secured directly to the second flanges of the structural liner panels. This wall can be designed for a one-way structure or for a two-way structure.

The resulting wall has a significant cost saving in the liner system and facing system. All subgirts are eliminated thereby not only saving the cost of the subgirts but also enabling a substantial reduction in the thickness of the facing wall system. The total shipping volume for the wall liner is significantly less than that required for conventional liner systems. The application of thermal insulation is facilitated. When the liner wall is secured horizontally to the building framework, the intermediate vertical girts sustain less of the total applied load and therefor can be reduced in size and weight.

When the liner wall is secured vertically to the building framework, the intermediate horizontal girts are themselves supported by the structural liner panels and the need for sag-rods is eliminated.

To illustrate a specific design of Example 3, the following design parameters were adopted (a) A 24 feet base structure, 24 feet high requiring 4 inches (thickness) of thermal insulation.

(b) Wind load is 30 lbs. per square foot.

(c) The facing panels are V-beam panels as manufactured by the E. G. Smith Division of Cyclops Steel Corporation.

(d) The liner profile has a 24 inch width and a 1.5 inch depth.

(e) The maximum allowable deflection is 1/180 of the span length.

(f) The maximum allowable steel stress in the facing panels and the liner panels is 26,667 lbs. per square inch.

In order to assemble a conventional wall from standard components, the required subgirts are 2½ inches thick to accommodate the required 4 inches of thermal insulation. However the thermal insulation in such conventional wall is compacted in the region of each subgirt which renders the insulation less effective in the regions of the subgirts where it is compacted. The conventional wall requires an intermediate horizontal structural girt.

The corresponding one-way design wall of this invention employs a single vertical structural girt between the vertical columns to provide for 12 foot spacing for horizontally applied liner panels. The liner panel span is thus 12 feet. The structural liner panels are provided at 4 feet spacings, i.e., the non-structural liner panel is 46 inches wide and the first flange of the structural liner panel is 2 inches wide. The second flange of the structural liner panel likewise is 2 inches deep. The web of the structural liner panel is 4 inches deep. The lips of the non-structural liner are ¾ inch long. The terminal lip on the second flange of the structural liner panel is 0.7 inch.

The following table illustrates the difference between the designs employing conventional double-metal skin panel products and the design according to the present invention.

TABLE 2

| | EXAMPLE 3 | | | |
|---|---|---|---|---|
| | CONVENTIONAL | | INVENTION | |
| ITEM | Gauge | Wt* | Gauge | Wt* |
| Facing Panels | 20 | 2.02 | 24 | 1.39 |
| Liner Panels | 18 | 2.31 | — | — |
| Non-structural Liner Panels | — | — | 26 | 0.758 |
| Structural Liner Panels | — | — | 12 | 1.039 |
| Total Wt* | | 4.33 | | 3.187 |

*Pounds of metal per square foot of wall area

The conventional wall requires in addition, 24 feet of top structural girt members and 24 feet of structural base members as well as 120 feet of subgirt members—none of which is required in the design which employs the present invention. Both the conventional design and the invention design require 12 feet of intermediate structural girt—horizontal in the case of the conventional design and vertical in the case of the present design.

Further Embodiments

Figure 12:
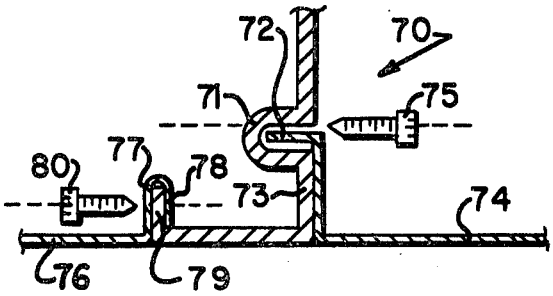
FIGS. 12 and 13 are fragmentary cross-section views similar to FIG. 3, showing alternative embodiments of connection means between structural liner panels and non-structural liner panels.
Figure 13:
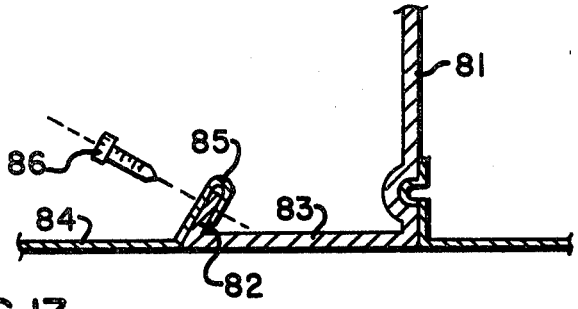
Figure 14:
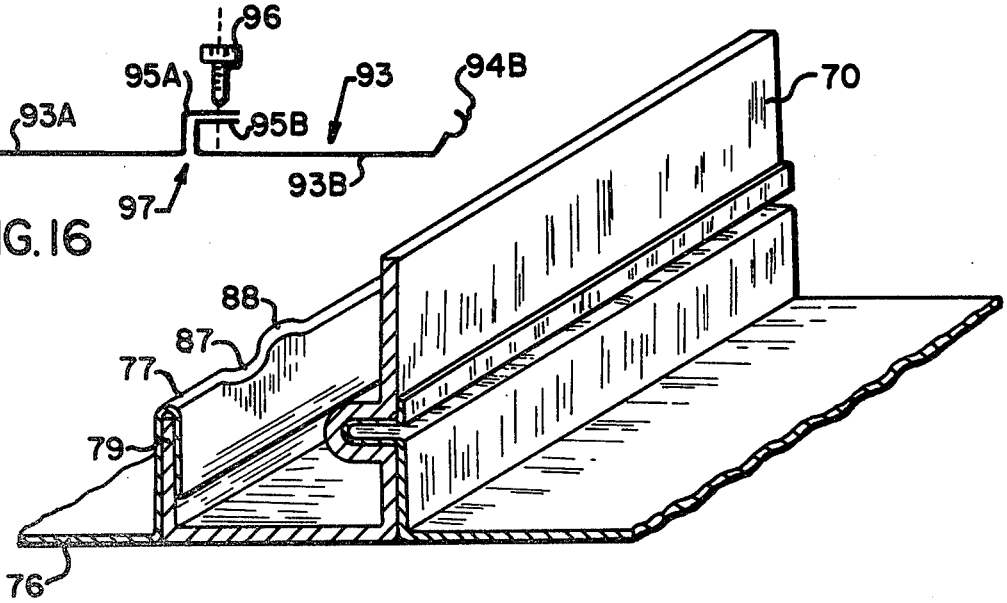
FIG. 14 is a fragmentary perspective illustration of a further alternative embodiment of joint connections between structural liner panels and non-structural liner panels showing alternative connecting means.

The shape of the lips on the non-structural liner panels can be altered to accommodate different terminal lips and web constructions on the structural liner panels as shown in FIGS. 12, 13, 14. Referring to FIG. 12, the structural liner panel 70 has a deep channel-like groove 71 for receiving an outwardly extending flange 72 from the lip 73 of the non-structural liner 74. A fastener 75 can be driven into the channel-like groove 71 to provide positive mechanical connection between the structural liner panel 70 and the non-structural liner panel 74. Also in FIG. 12 a non-structural liner panel 76 has a J-shaped lip 77 with an outwardly depending free edge 78. The J-shaped lip 77 fits over an upwardly presented terminal lip 79 and is secured thereto by means of a fastener 80 which is driven through the J-shaped lip 77 and the terminal lip 79 and the outwardly depending surface 78. Appropriate caulking sealant substances may be placed in the channel of the J-shaped lip 77 and in the channel-like groove 71.

As shown in FIG. 13, structural liner panel 81 has its terminal flange 82 bent at an acute angle with respect to the first flange 83. A non-structural liner panel 84 has a terminal J-shaped lip 85 formed at an obtuse angle so that the terminal lip 82 can be received within the channel of the J-shaped lip 85. A supply of caulking sealant is normally placed within the channel of the J-shaped lip 85. A suitable fastener 86 secures the structure by extending through the J-shaped lip 85 and the terminal flange 82. One of the advantages of the structure shown in FIG. 13 is that the line of driving for the fastener 86 is convenient for a fastener operator.

The connection of FIG. 12 is repeated in a perspective view in FIG. 14 wherein the terminal flange 79 and the J-shaped lip 77 are deformed as shown at 87, 88 by a convenient twisting tool. This provides a positive mechanical connection between the non-structural liner panel 76 and the structural panel member 70 which does not require welding or screw type fasteners.

Figure 15:
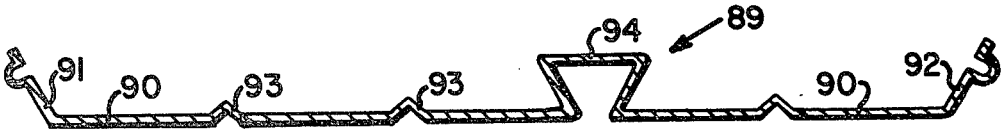
FIG. 15 is a cross-section illustration of an alternative embodiment of the non-structural liner panel.

A further embodiment illustrated in FIG. 15 provides a non-structural liner panel 89 having a central surface 90 and laterally outwardly presented marginal lips 91, 92. This construction greatly improves the nestability of the non-structural liner panels for shipment. When these non-structural liner panels are assembled in a liner wall, the laterally outwardly presented lips, 91, 92 tend to snap into place and facilitate wall assembly.

In place of the conventional stiffening ribs 93 as shown in FIG. 15, it is possible to provide a dove-tail shaped rib 94 of which can serve as a receiving trough for mounting shelf-supporting brackets or other supporting devices on the interior walls of the building. The use of such dove-tail shaped reinforcing ribs of course, interferes with the nestability of the non-structural liner panels.

A further advantage of the present invention is that the non-structural liner panels can be secured to a building framework with inexpensive fasteners such as structural adhesives or explosive driven rivets. The non-structural liner panels, which constitute the preponderance of the liner wall surface area in the present invention, make no structural contributions to the design of the building wall.

Figure 16:
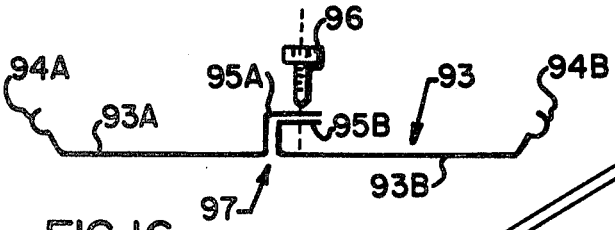
FIG. 16 is a cross-sectional view of a still further alternative embodiment of a non-structural panel formed from two connected portions having a central, lengthwise joint.

FIG. 16 illustrates a further alternative construction of a non-structural panel 93 which is formed from two connected panel portions 93*a*, 93*b* and having one lateral lip 94*a*, 94*b*, respectively for connection to a structural panel (not shown) and also having marginal joint-forming elements 95*a*, 95*b* for connection with each other. The joint forming elements 95*a*, 95*b* may be mechanically joined by fasteners 96 or by crimping the elements. A bead of sealant (not shown) is provided between the elements 95*a*, 95*b* for an air-tight connection. The gap 97 can be made varied by perhaps $\frac{1}{4}$-inch to provide a width adjustment of about $\frac{1}{8}$-inch in either direction to accommodate dimension variances in the building framework.

The flanges 12, 14 are shown herein as extending in opposite directions from the web 13. Both flanges 12, 14 may extend in the same direction if desired.

What is claimed is:

1. A building wall liner assembly secured to a building frame and formed from alternating structural liner panels and non-structural liner panels, comprising:

parallel, spaced apart sheet metal structural liner panels, each having a web and a first flange at one end extending normally from said web, a second flange at the other end extending normally from said web, a terminal lip on said second flange, the said second flange of each of said structural panels being connected to a building frame, said first flanges being in a common surface and said second flanges being in a common surface;

sheet metal non-structural liner panels having a metal thickness which is less than the metal thickness of said structural panels, each of said non-structural liner panels having a central surface and parallel marginal connecting elements along two opposed side edges thereof;

said non-structural liner panels being secured to said building frame between adjacent ones of said structural liner panels by means of connections between said central surface and said frame, said non-structural liner panels being further engaged along one of said side edges with a web of one said structural liner panel and being engaged along the other of said side edges to said terminal lip of the adjacent one of said structural liner panels;

whereby said second flanges and said central surfaces are in a common surface and comprise the liner wall surface of said building.

2. The building wall assembly of claim 1 wherein said structural liner panels have a sheet metal thickness of 20 gauge to 10 gauge and said non-structural liner panels have a thickness of 26 gauge to 20 gauge.

3. A building wall liner assembly of claim 1 wherein the said terminal lip of said second flange has a lengthwise groove and the said web has a lengthwise groove; and the said marginal connecting elements of each of said non-structural liner panels are flanges, each having a lengthwise bead corresponding to the said grooves of the said second flange and the said web; one of said beads being engaged in the said lengthwise groove of said second flange of one structural liner panel and the other of said beads being engaged in the said lengthwise groove of the said web of the adjacent structural liner panel.

4. The building wall liner assembly of claim 3 wherein the said marginal connecting elements of said non-structural liner panels comprise laterally outwardly presented lips.

5. The building wall liner assembly of claim 3 wherein the said non-structural liner panel is formed from two sections, with a central lengthwise joint connecting the two said sections.

6. A building wall liner assembly comprising:

parallel, spaced apart sheet metal structural liner panels, each having a web;

first connection means at the outboard edge of said web;

second connection means at the inboard edge of said web;

said second connection means being secured to a building frame;

sheet metal non-strutural liner panels each having a central surface and parallel marginal connection elements along two opposed side edges thereof;

said sheet metal non-structural liner panels being secured to said building frame between adjacent structural liner panels;

each of said marginal connecting elements being engaged with a structural liner panel;

the said sheet metal non-structural liner panels having a metal thickness which is less than that of the said structural panels;

the inner wall surface of said wall liner assembly comprising the said central surface of said non-structural liner panels and a portion of said second connection means.

7. The building wall liner assembly of claim 6 wherein the said second connection means comprises a flange and lip and wherein a lengthwise groove is provided in the said web adjacent to the said second flange.

8. The building wall liner assembly of claim 6 wherein the said web is provided with a lengthwise open channel and wherein one of said marginal connecting elements is a terminal flange engaged in the said open channel.

9. The building wall liner assembly of claim 6 wherein the said second connection means includes a flange and lip and wherein one of the said marginal connecting elements comprises a channel adapted to fit over the said lip.

10. The building wall liner assembly of claim 9 wherein the said lip and the said channel are inclined toward the said web.

11. The building wall liner assembly of claim 9 wherein the said channel and lip are secured together by deformation.

12. A building wall assembly secured to a building frame, comprising:

a liner wall including:

parallel, spaced apart sheet metal girts, each having a web;

first connection means at the inboard edge of said web;

second connection means at the inboard edge of said web;

said second connection means being secured to said building frame;

sheet metal non-structural panels secured to said frame between said structural liner panels;

a facing wall, secured to said liner wall and including:

sheet metal facing panels secured to said first connections;

said facing panels and said non-structural liner panels each having a metal thickness which is less than that of said structural panels; and the inner surface of said building wall comprises a major portion of said non-structural panels and a portion of the said second connection means.

13. The building wall assembly of claim 12 wherein the said facing panels have uniform lengthwise profiles and are secured directly to said first connection means with the lengthwise direction of said facing sheets spanning across two or more of said structural liner panels.

14. The building wall assembly of claim 12 wherein sheet metal subgirts are secured to said first connection means, each of said subgirts spanning the distance between adjacent ones of said structural liner panels; and wherein the said facing sheets have uniform lengthwise profiles and are secured to said structural panels with the lengthwise direction of said facing sheets spanning the distance between adjacent subgirts.

* * * * *